United States Patent [19]

Wareham

[11] 3,936,851

[45] Feb. 3, 1976

[54] EVER-READY CAMERA CASE

[75] Inventor: Richard R. Wareham, Marblehead, Mass.

[73] Assignee: Polaroid Corporation, Cambridge, Mass.

[22] Filed: Sept. 26, 1974

[21] Appl. No.: 509,693

[52] U.S. Cl. ..... 354/288; 354/194

[51] Int. Cl.² ..... G03B 17/02

[58] Field of Search ..... 354/288, 194; 150/52

[56] References Cited

UNITED STATES PATENTS 2,681,600 6/1954 Heldecke ..... 354/288

*Primary Examiner*—John M. Horan

*Attorney, Agent, or Firm*—Alfred E. Corrigan

[57] ABSTRACT

A carrying case is disclosed for photographic cameras of the compact collapsible type which may be extended or erected to an operative position without removal of the camera from the case. The case is constructed to safely contain the camera and securely support the same in all positions of camera movement from a compact folded position to a fully erected position and to permit complete operation of the camera during all normal photographic procedures, including the removal and insertion of film cassettes into a film magazine receiving chamber of the camera without the necessity of removing the camera from the case. The case is formed of specially constructed top and bottom case members that are provided with hinged sections and cooperating linkage which are movable with the camera's housing sections during the erection of the camera to its operative position.

10 Claims, 2 Drawing Figures

EVER-READY CAMERA CASE

CROSS REFERENCE TO RELATED APPLICATIONS

This application is related to the following commonly assigned applications, all filed concurrently herewith:

Ser. No. 509,694 entitled CAMERA CARRYING CASE OR SIMILAR ARTICLE, filed in my name and Ser. No. 509,694 entitled IMPROVED EVER-READY CAMERA CASE, filed in the name of Thomas A. Svatek.

BACKGROUND OF THE INVENTION

1. Field of the Invention

This invention is directed to an ever-ready carrying case for photographic cameras and in particular to a case for securely retaining and supporting a camera of the compact collapsible type.

2. Description of the Prior Art

Carrying cases which permit a photograph to be taken without removing the camera from the carrying case are well known in the art and are often referred to as ever-ready cases. However, even though it is possible in these prior art instances to take photographs without removing the camera from the carrying case, it is nevertheless generally required that the camera be removed from the carrying case when the film is to be changed. This presents a recognizable disadvantage to the quick, efficient and convenient use of the camera.

Furthermore, the prior art is silent, or at best, has never completely solved the problem of providing a carrying case that will accommodate and adequately support a camera of the compact collapsible self-developing type which may take the form of a foldable camera of the single-lens reflex type which is folded to a slim compact storage configuration when not in use and which may be erected to a fully upright position when it is to be used. This is particularly true when considering a camera of the type disclosed and described in U.S. Pat. No. 3,810,211 by Richard R. Wareham and Richard Paglia entitled Self-Developing Camera System where the camera includes a plurality of housing members which are pivotally coupled to one another for relative movement between the compact collapsed inoperative position and the extended or erected operative position.

SUMMARY OF THE INVENTION

The present invention has as its primary object the provision of a carrying case for a collapsible type camera which will adequately support the camera in all conditions, namely from a fully inoperative collapsed position to a fully erected operative position and with which full access is available to the camera for performing normal photographic procedures including the changing of film cassettes, thus overcoming the referred to disadvantages of the prior art.

This is accomplished by forming the carrying case of specially constructed top and bottom case portions that are provided with hinged sections and cooperating linkage which permit the parts of the case to move with the camera's pivoted housing sections during the erection of the camera to an operative position and during the return of the sections to a fully collapsed inoperative position.

Other objects of the invention will in part be obvious and will in part appear hereinafter.

The invention accordingly comprises a carrying case possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein like numerals have been employed in the different figures to denote the same parts and wherein.

DETAILED DESCRIPTION OF THE INVENTION

Figure 1:
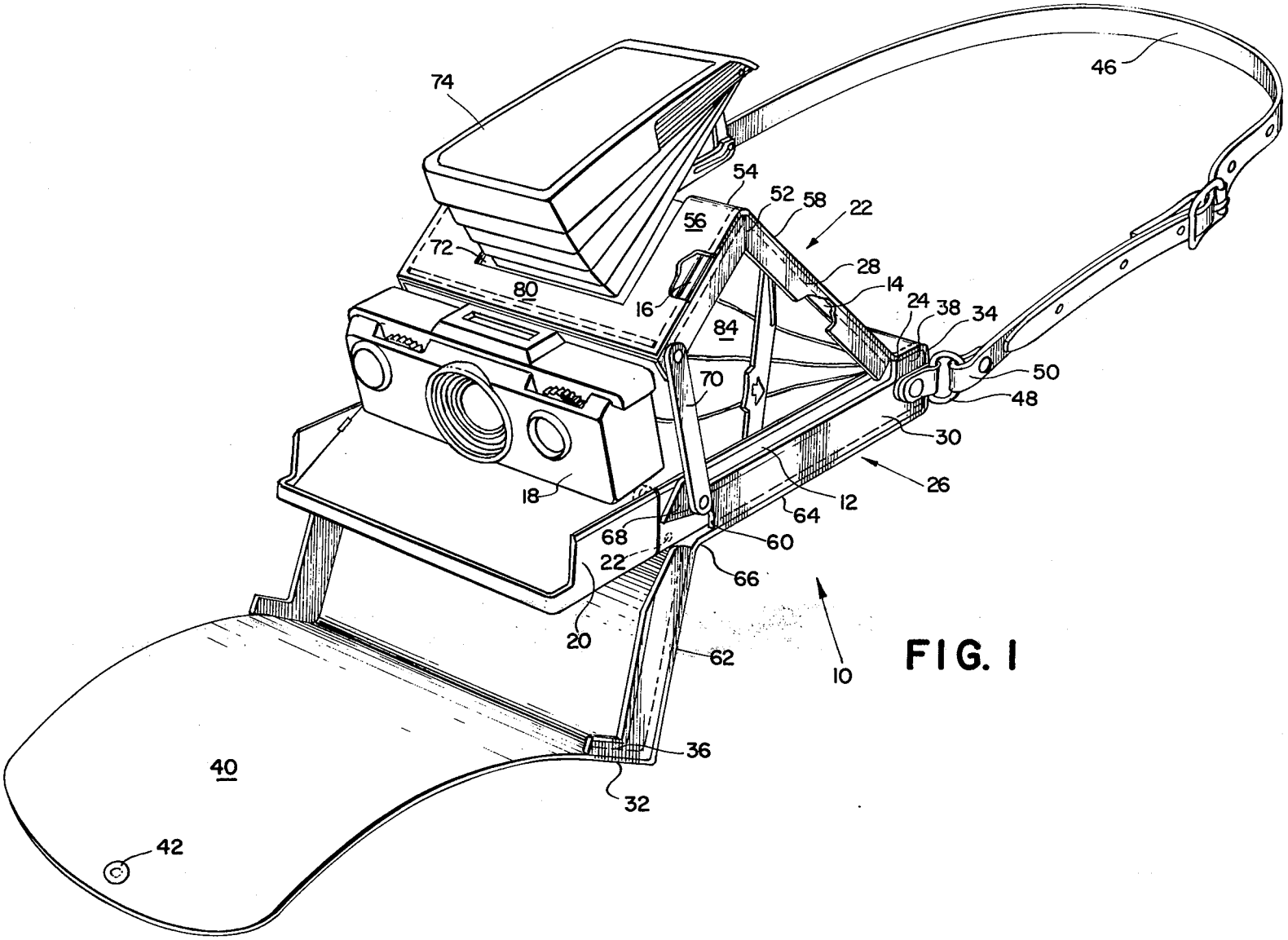
FIG. 1 is a perspective view of the carrying case and camera in the extended or erected operative position that the camera will take for all normal photographic procedures.
Figure 2:
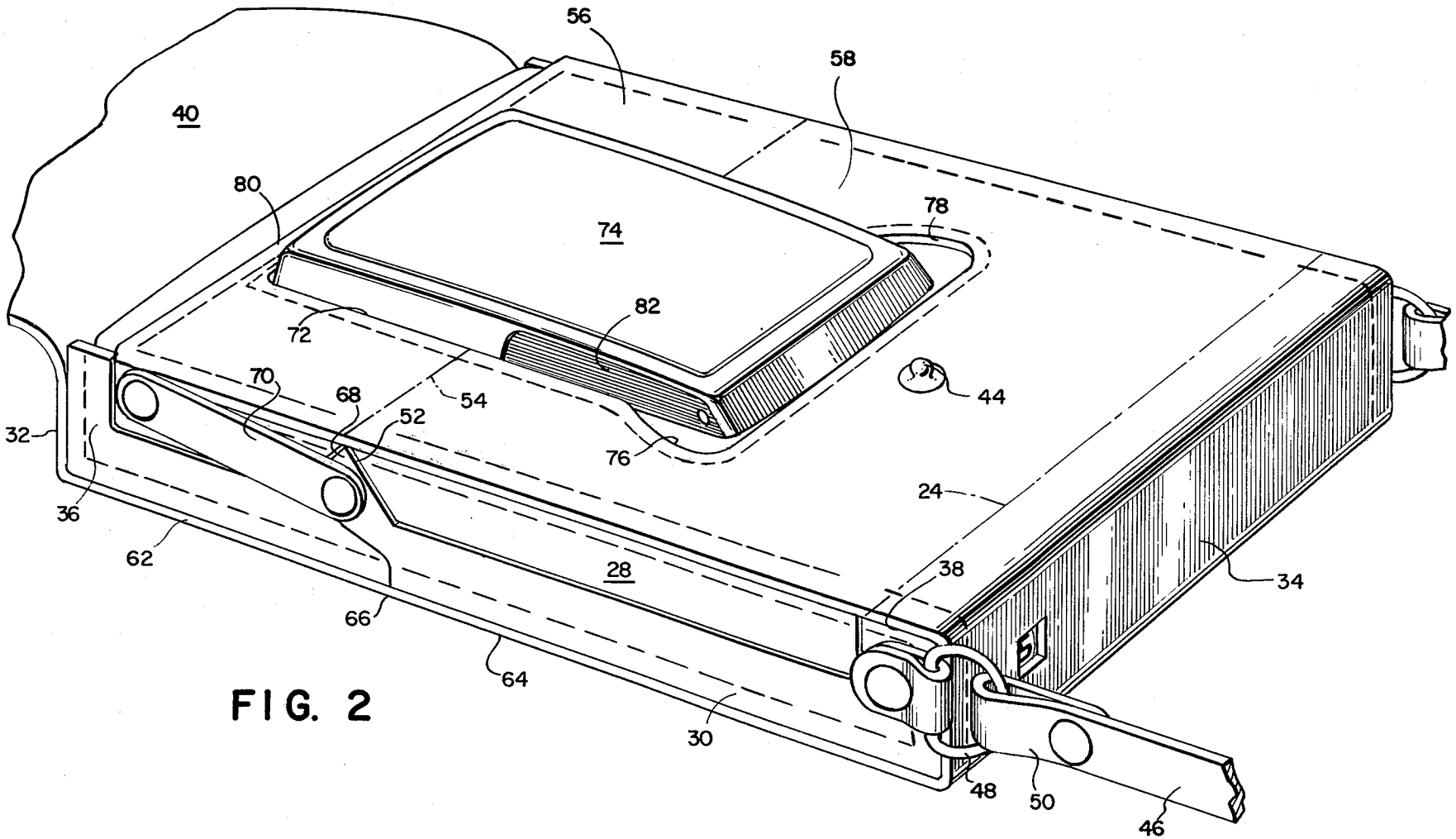
FIG. 2 is an enlarged perspective view of the carrying case of the present invention with the case shown in closed position and housing the camera in closed and collapsed condition, with a cover flap of the case unfastened and folded out of the way to disclose the opening in the top sections of the case to accommodate the viewfinder of the camera and to permit access thereto for erecting the camera and case to their operative positions.

The carrying case of the present invention is generally designated 10 in the drawings where it is shown in its preferred embodiment as providing a novel construction for housing and carrying of a camera of the general type disclosed in U.S. Pat. No. 3,810,211 which includes a plurality of housing sections 12, 14, 16 and 18 pivotally coupled to one another for relative movement between a compact folded or collapsed inoperative position, as shown in FIG. 2, and an extended or erected operative position, as shown in FIG. 1 wherein sections 12 and 16 define an acute angle therebetween. Extending forwardly of housing section 12 is a spread roller housing 20. Housing 20 is pivotally coupled to an inner frame of the camera at hinge 22 for pivotal movement in a counterclockwise manner to a position wherein a film cassette may be inserted into a cassette receiving chamber located within housing section 12, as is well known in the art.

The case 10 may be made of various materials customarily used in the art of camera carrying cases, such as natural leather, artificial leather, and even plastic material, all of which are particularly well suited to carry out the intended function of the case. Case 10, preferably formed of leather, comprises a top portion 22 which is intergrally hinged at 24 to a bottom portion 26 at the right hand side of the case, as viewed in the drawings. Both top and bottom portions 22 and 26 of the case are provided with relatively rigid side walls 28 and 30 which are secured by stitching, or the like, to the flexible leather portions of the top and bottom portions, with the edges of side walls 28 of the top portion adapted to abut the edges of side walls 30 of the bottom portion 26 when the case is closed, as seen in FIG. 2. Additionally, the bottom portion 26 of the case is provided with upstanding end walls 32 at the front end of the case and 34 at the rear of the case, which are rigidly supported in position by upstanding rigid portions 36 and 38 of the side walls on each side of the case, said rigid portions 36 and 38 extending upwardly about twice the height of the side walls 30 of the bottom portion to thereby abut the ends of side walls 28 and provide end walls that completely close off both ends of the case when the top portion 22 is in the position shown in FIG. 2.

At the front end of the case, flexible cover flap 40 is provided which forms an integral extension of the upper portion of the end wall 32 and is adapted to cover a major portion of the top portion 22 of the case and be securely held in place by suitable means, such as snap fastener elements 42 and 44 carried by the flap and top portion, respectively.

An adjustable neck strap 46 is secured to the rear end of the case with each end of the strap being secured to a ring 48 securely held by a strap loop 50 riveted or otherwise fastened to the side wall portions 38.

In the preferred form of the invention as shown, the flap 40, the end walls 32 and 34 and the top and bottom wall portions 22 and 26 are formed of a flexible leather and preferably this may be a single, integral piece of flexible leather. This is important since as will be explained hereinafter, wherever the rigid side wall support for the top or bottom portions is omitted or cut-away, on both sides of the case, a flexible integral hinge connection is formed and these hinges become very important in the specific functioning of the carrying case.

Both the top and bottom portions 22 and 26 have cut-out sections in their respective rigid side walls 28 and 30 on each side of the case to divide each portion into hinged sections. For example, the side wall 28 of top portion 22 are cut-away at 52 to form a hinged connection at 54 between section 56 and 58 of the top portion 22 so that the sections 56 and 58 may move to the position shown in FIG. 1 to accommodate housing sections 14 and 16 of the erected camera.

The side walls 30 of the bottom portion 26 are cut-away at 60 to divide this portion into two sections 62 and 64 connected by an integral flexible hinge 66. This will permit the section 62 of the bottom portion 26 carrying end wall 32 and cover flap 40 to swing downwardly about the hinge 66 to open up the front end of the case for the removal and insertion of film cassettes into housing section 12.

Additionally, each of the side walls 30 at the end of section 64 in the vicinity of the cut-out 60 are provided with upstanding ears or flanges 68 to which are pivotally mounted one end of links 70, the other end of said links being pivotally mounted on the side walls 28 of top section 56 near the forward end thereof.

By virtue of the particular construction and arrangement of elements, the parts of the carrying case may be completely collapsed to the position shown in FIG. 2 with the sectional top and bottom case portions 22 and 26 completely encasing the collapsed camera and with the links 70 so positioned as to permit this movement with the links 70 nearly parallel to the case body.

In effect the case comprises a four section enclosure for the camera embodying the two upper sections 56 and 58 and the two lower sections 62 and 64. Additionally, the case defines a four bar linkage consisting of the side walls 28 of sections 56 and 58, the side walls 30 of section 64 and the links 70. This four bar linkage prevents the camera from falling out of the case when the sections of the case are in the positions shown in FIG. 1 and the camera is hanging from the user's neck.

The top portion 22 is also provided with a relatively large cut-out portion 72 extending from the forward portion of section 56, which lies close to the end wall 32 when the case is closed, across the hinge 54 and well into section 58. This cut-out portion is generally rectangular in configuration and of sufficient size and dimensions to accommodate the outer cover or cap 74 of the viewfinder of the self-developing camera, which cap protrudes through the opening. Cut-out portion 72 is provided with a pair of outwardly extending recesses 76 and 78 which facilitate the grasping of cap 74 prior to erecting the camera and case 10.

The camera in folded and collapsed form is readily inserted through the front end of the case. The flap 40 is then pulled over the top and fastened in position. The flap is of sufficient length and width to fully cover and protect the viewfinder cap 74. The case and camera may then be carried by the neck strap in an inoperative and collapsed condition.

When the camera is to be used and while the case and camera are still supported by the neck strap, the flap 40 is unfastened and allowed to hang down from the front end of the case. The front end wall 32 at this point will still snugly fit the camera and together with a section 80 of portion 56 which engages the left end of the cap 74 will prevent the camera from sliding forward and falling out of the case. The cap 74 of the viewfinder which protrudes through the rectangular opening 72 is then grasped at each side at 82 and pulled upwardly and to the rear while the camera and case is firmly held with the other hand. This movement of the viewfinder will erect the camera to its operative position and the upper portions 56 and 58 of the case will follow the camera's movement until the parts reach the position shown in FIG. 1. In this opened position, the camera is securely held by the parts of the case and the same may still be safely hung from the neck.

When the camera is erected and the parts of the case moved to the position of FIG. 1, the front end section 62 of the bottom portion of the case will be allowed to pivot downwardly about the hinge 66 which will permit the user to have access to the spread roller housing 20 which is pivotally connected to the front end of the camera about hinge 22. The integral hinge 66 between the two bottom sections 62 and 64 is located at a point approximately ¼ inch to the right of the hinge 22 of the roller housing 20, so as to permit the roller housing 20 to be pivoted downwardly through approximately a 90° angle in a counterclockwise direction, as viewed in FIG. 1, to enable a film cassette to be inserted into or removed from the main housing section 12 of the camera. If the hinge 66 is too close to the pivot point 22, or forward of it, the user will not be able to pivot the spread roller housing 20 properly to remove or insert film cassettes. Furthermore, if the hinge 66 is spaced too far to the right of pivot point 22, the center of gravity of the camera may be forward or to the left of the point at which the user's hand grasps bottom section 64, thereby making it uncomfortable for the user to handle.

Furthermore, the hinge 54 between top sections 56 and 58 and the links 70 should be so designed and placed as to accommodate the pivoted parts of the camera body, including the erected bellows section 84 and the camera lens front included in housing section 18.

By virtue of the particular carrying case structure described and disclosed in the drawings, it will be seen that many photographic procedures and operations may be performed, including the changing of film cassettes or cleaning of the processing rollers of the camera without having to remove the camera from the carrying case.

Since certain changes may be made in the above-described carrying case without departing from the scope of the invention herein involved, it is intended that all matter contained in the above description, or shown in the accompanying drawings, shall be interpreted as illustrative and not in a limiting sense.

What is claimed is:

1. A carrying case of the ever-ready type for a photographic camera of the compact collapsible type which is extendible and erectible to a fully operative position in use, said carrying case comprising:

a top portion and a bottom portion transversely hinged to each other near a rear end of said case, said top portion including a transverse hinge dividing said top portion into forward and rear sections and said bottom portion including a transverse hinge dividing said bottom portion into forward and rear sections; and means connecting a forward end of said forward section of said top portion to a forward end of said rear section of said bottom portion, said top portion being movable from a closed position with respect to said bottom portion to an erected position on erection of the camera to its operative position, with said forward and rear sections of said top portion assuming an inverted V-shape configuration which snugly fits and retains erected parts of the camera and with said connecting means adequately spacing said forward end of said forward top section from said lower rear sections.

2. A carrying case as defined in claim 1 wherein said forward section of said bottom portion of said case includes an end wall and a flexible cover flap extending from an upper portion of said end wall.

3. A carrying case as defined in claim 2 wherein said forward section of said bottom portion is free to pivot downwardly on erection of the camera to the operative position to expose a camera housing part which is pivotally mounted on the camera body and which can be swung downwardly to uncover a film cassette receiving chamber for the insertion or removal of a film cassette without having to remove the camera from the carrying case.

4. A carrying case as defined in claim 3 wherein said transverse hinge of said bottom portion is positioned just rearwardly of the pivot point of the pivotally mounted camera housing part to permit the housing part to be pivoted downwardly a sufficient distance to uncover the film cassette receiving chamber without interference with said downwardly extending forward section of said bottom portion.

5. A carrying case as defined in claim 1 wherein said top and bottom portions and said transverse hinged form a four section enclosure for the camera.

6. A carrying case as defined in claim 1 wherein said top and bottom portions are formed with top and bottom walls of flexible material having relatively rigid side walls affixed thereto, said side walls including cut away portions in the region of said transverse hinges so that said hinges are formed by the flexible material of said top and bottom walls.

7. A carrying case as defined in claim 1 wherein said forward and rear sections of said top portion include a rectangular opening extending across said transverse hinge of said top portion through which a portion of the camera protrudes and which provides access thereto when the camera is to be erected to operative position.

8. Photographic apparatus comprising, in combination:

a photographic camera including first, second and third housing sections mounted for movement between a folded inoperative position and an erected operative position wherein said first and third housing sections define an acute angle therebetween; and a carrying case including a first section adapted to receive said first housing section; a second section including a hinge dividing said second section into first and second portions with said first portion adapted to overlie said third housing section and said second portion adapted to overlie said second housing section when said camera is in said folded and erected positions; and means coupling said first and second sections for movement with said first, second and third housing sections between said folded and erected positions, said coupling means including means for limiting movement of said first portion of said second section relative to said first section to a position wherein it defines an angle with said first section substantially equal to said acute angle.

9. The combination defined in claim 8 wherein said limiting means includes a link extending between said coupled to said first section and one end of said first portion of said second section.

10. The combination defined in claim 8 wherein said camera further includes a fourth housing section extending forwardly of said first housing section and means for pivotally coupling said fourth housing section to said first housing section, and said first section of said carrying case further includes a hinge dividing said first section into first and second portions, said hinge being located just rearwardly of said pivot means whereby said fourth housing section may be pivoted to a position permitting access to the interior of said fourth housing section.

* * * * *